US009108102B2

(12) United States Patent
Tudor

(10) Patent No.: US 9,108,102 B2
(45) Date of Patent: Aug. 18, 2015

(54) STYLIZED APPARATUS FOR BINDINGLY ACCEPTING A STRAP INCLUDING SNOWBOARD IMPROVEMENTS AND ACCOUTUREMENTS

(71) Applicant: Sean Tudor, Los Angeles, CA (US)

(72) Inventor: Sean Tudor, Los Angeles, CA (US)

( * ) Notice: Subject to any disclaimer, the term of this patent is extended or adjusted under 35 U.S.C. 154(b) by 0 days.

(21) Appl. No.: 14/462,309

(22) Filed: Aug. 18, 2014

(65) Prior Publication Data

US 2015/0048597 A1 Feb. 19, 2015

Related U.S. Application Data

(60) Provisional application No. 61/866,793, filed on Aug. 16, 2013.

(51) Int. Cl.

| | |
|---|---|
| ***A63C 9/00*** | (2012.01) |
| ***A63C 10/06*** | (2012.01) |
| ***A63C 11/00*** | (2006.01) |
| ***A43C 9/02*** | (2006.01) |
| *A63B 29/00* | (2006.01) |
| *B63B 35/81* | (2006.01) |
| *A45F 3/00* | (2006.01) |

(52) U.S. Cl.

CPC . *A63C 10/06* (2013.01); *A43C 9/02* (2013.01); *A63C 11/00* (2013.01); *A45F 2003/001* (2013.01); *A63B 29/00* (2013.01); *A63C 2203/08* (2013.01); *B63B 35/812* (2013.01)

(58) Field of Classification Search

USPC ..... 280/619

See application file for complete search history.

(56) References Cited

U.S. PATENT DOCUMENTS

| | | | | |
|---|---|---|---|---|
| 4,028,981 | A * | 6/1977 | Cravens | 84/327 |
| 5,356,159 | A | 10/1994 | Butterfield | |
| 5,609,347 | A | 3/1997 | Dressel | |
| 5,857,700 | A | 1/1999 | Ross | |
| 6,250,651 | B1 | 6/2001 | Reuss et al. | |
| 6,604,746 | B1 | 8/2003 | Sato et al. | |
| 6,644,681 | B2 | 11/2003 | Couderc et al. | |
| 6,773,020 | B2 | 8/2004 | Gonthier | |
| 6,974,149 | B2 | 12/2005 | Naito et al. | |
| 7,011,333 | B2 | 3/2006 | Pascal | |
| 7,036,830 | B2 | 5/2006 | Gonthier | |
| 7,694,994 | B2 | 4/2010 | Lang et al. | |
| 7,887,082 | B2 | 2/2011 | Caslowitz | |
| 8,226,108 | B2 | 7/2012 | Pontano et al. | |
| 8,276,921 | B2 | 10/2012 | Walker | |
| 8,356,822 | B2 | 1/2013 | McLeod et al. | |
| 8,371,004 | B2 | 2/2013 | Huber et al. | |
| 8,424,168 | B2 | 4/2013 | Soderberg et al. | |
| 8,500,151 | B2 | 8/2013 | Metchik | |
| 2002/0000707 | A1 | 1/2002 | Couderc | |
| 2012/0255980 | A1 | 10/2012 | Caslowitz | |
| 2012/0292887 | A1 | 11/2012 | Ohlheiser | |

* cited by examiner

*Primary Examiner* — John Walters
*Assistant Examiner* — James Triggs
(74) *Attorney, Agent, or Firm* — Brown Rudnick, LLP; Peter Jon Gluck

(57) ABSTRACT

An improved supplemental binding attachment scheme involving an extended strap and customizing tool enables customizing of a strapped article of leisure wear. The customizing tool may take the form of a stud, or any number of personalized shapes, including characters, strings, logos, icons and anything that attaches to show that any article belongs to a user. Kits, straps, and software based instructions are likewise included in the present disclosure.

13 Claims, 4 Drawing Sheets

STYLIZED APPARATUS FOR BINDINGLY ACCEPTING A STRAP INCLUDING SNOWBOARD IMPROVEMENTS AND ACCOUTUREMENTS

CROSS REFERENCE TO RELATED APPLICATIONS

This application claims the benefit of U.S. provisional patent application No. 61/866,793, filed Aug. 16, 2013, the entire disclosure of which is incorporated herein by reference.

FIELD OF THE INVENTION

The present disclosure relates generally to the field of binding systems and devices with improved attachment and detachment of the same. More particularly, the disclosure relates to those systems and devices which can be used to bind snowboards or other similar sporting apparatuses.

BACKGROUND

Snowboarding is a recreational sport that combines certain aspects of skiing and skateboarding. It is practiced on an elongated board with boot-binding fixtures which allow a user to fasten the board to his boots. The board must be securely fastened to the user's boots while the user snowboards downhill. However, when walking or shuffling along a substantially level surface, the user must detach one or both boots from the board in order to easily move about.

During a typical day of snowboarding, a snowboarder may go on dozens of runs down a slope, each time having to detach and reattach his bindings in order to move about and get on and off the chairlift. For those reasons, it is desirable for boot bindings to be, on the one hand, secure and tightly fastened while snowboarding downhill, and on the other hand, easily detachable when moving around on even surfaces.

Various improvements have been attempted with respect to boot bindings, including the inventions described in U.S. Pat. Nos. 5,356,159; 5,609,347; 5,857,700; 6,250,651; 6,604,746; 6,644,681; 6,773,020; 6,974,149; 7,011,333; 7,036,830; 7,694,994; 7,887,082; 8,226,108; 8,276,921; 8,356,822; 8,371,004; 8,424,168; and 8,500,151; as well as U.S. Patent Publication Nos. 2002/0000707; 2012/0255980; and 2012/0292887. The contents of all U.S. Patents and Publications cited herein are incorporated by reference in their entirety, as if fully set forth herein.

Despite the improvements noted above, there still exists a need to more easily facilitate the attachment and detachment of bindings. One problem with bindings currently know in the art that utilize straps to secure the binding, when the male strap becomes completely dislodged from the female connection piece, it is difficult to feed the male piece back through quickly and efficiently. This is especially true when the user is wearing gloves or mittens, which is generally the case when snowboarding or engaging in other cold-weather outdoor activities. A mechanism that obviates the need to feed a male end through a female end would be a particularly useful advancement. Snowboarders also have a need to definitively identify their snowboards from those of other users, particularly when the board is detached and commingled with other users' equipment. The present invention provides devices and systems that make attachment and detachment of bindings easier, as well as provides a customizable feature to help identify the user's equipment. The invention addresses longstanding needs in the art and constitutes progress in science and the useful arts worthy of Letters Patent protection, it is respectfully proposed.

SUMMARY

This disclosure provides a device and system to allow the user to customize and provide for improved binding strap support and ready releasable fastening and detachment of the bindings as has not been heretofore provided. The invention of the present disclosure can be used in conjunction with any of the bindings and straps described in the above-referenced patents and applications, all of which are incorporated by reference in their entirety.

Briefly stated, an improved attachment scheme involving an extended strap and customizing tool enables rapid ingress and egress from a snowboard boot. The customizing tool may take the form of a stud or any number of personalized shapes, including characters, strings, logos, icons, and the like. In addition to preventing the strap from becoming detached, the attachment piece is useful to identify and distinguish the snowboard or other equipment from similar equipment belonging to others.

In an embodiment, the invention comprises at least an extended male snowboard strap comprising a proximal and distal end, the distal end configured to be threaded or passed through a female ratcheting mechanism receptor piece on one or both of the toe and ankle bindings and a customizable stud attached on or near the distal end of the strap, which when attached, prevents the male strap from slipping back through the female piece, thereby preventing the male and female components from being fully detached from each other when the stud is in place. The stud therefore functions not only to hold the bindings in place, but also to identify the equipment as belonging to a particular owner.

According to embodiments, there is disclosed, a method for improving attachment time for a snowboard binding, comprising; providing at least an extended male snowboard strap, matingly engageable at at least one of the toe and ankle attachment section of the respective binding portion; and at least a customizable studlike attachment member; grabbing the at least an extended male snowboard strap, matingly engageable at at least one of the toe and ankle attachment section of the respective binding portion proximate to the at least a customizable stud-like attachment member; and strapping in wherein the duration of the cycle comprises at least about three to at least about 10 seconds faster than conventional systems.

According to embodiments, there is disclosed an improved supplemental snowboard binding attachment scheme, comprising, in combination, at least an extended strapping member; and at least a customizable stud-like attachment member affixed proximate to the at least one extending strapping member for readily locating the same in space and making the subject snowboard distinct.

According to embodiments, there is disclosed a stylized apparatus for bindingly accepting a strap, belt, cord, or the like, the apparatus comprising a body; and a securement manner for securing the body to the strap, belt, cord, or the like. The device further comprising a customizable piece attached to the stud, wherein the customizable piece may be part of a matched-set of pieces for other personal leisure goods selected from the group of back-packs, ski-boots, wake board bindings, fanny-packs, travel gear, outdoor gear, climbing gear and boot straps.

BRIEF DESCRIPTION OF THE DRAWINGS

The above-mentioned features of the present disclosure will become more apparent with reference to the following description taken in conjunction with the accompanying drawings wherein like reference numerals denote like elements and in which.

Figure 1:
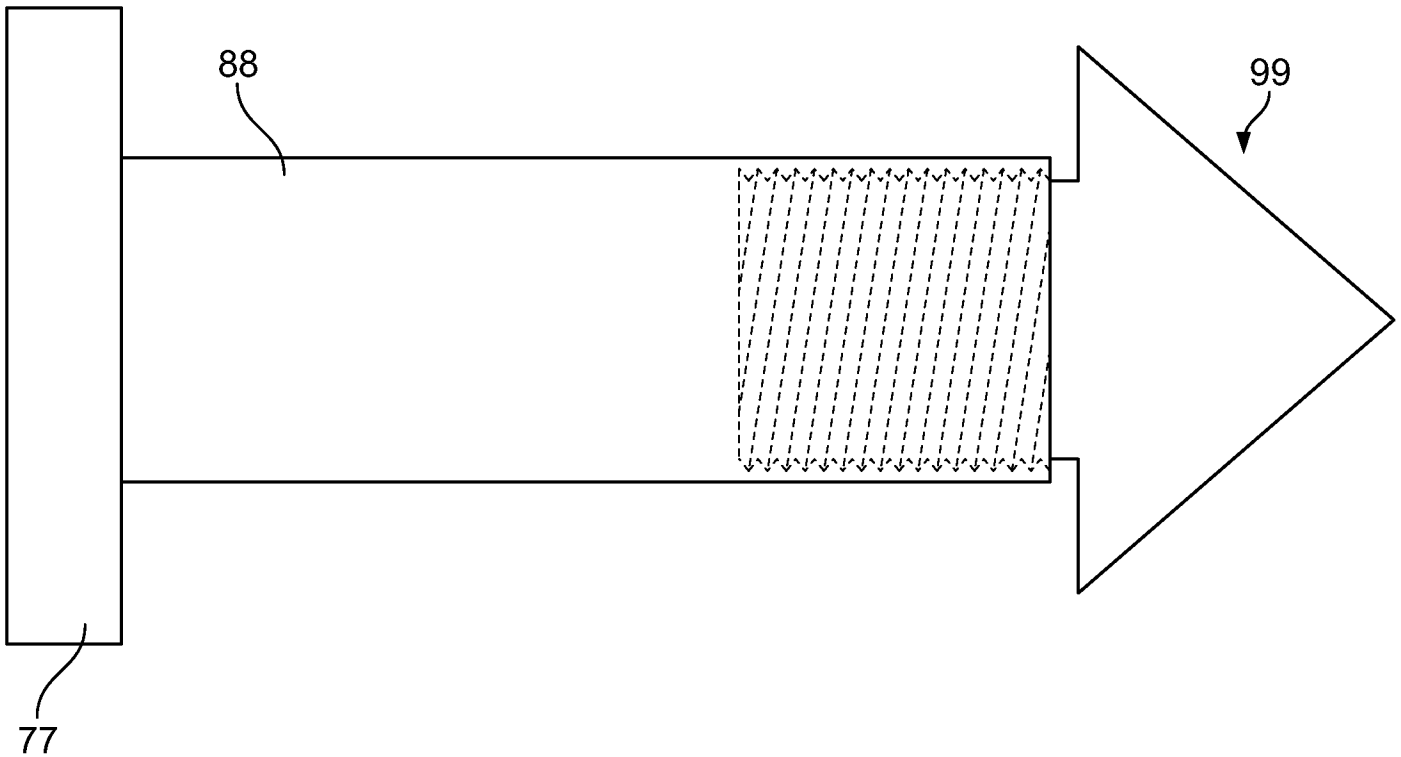
FIG. 1 shows a schematic of the device and apparatus of the present invention, not drawn to scale or connected to a snowboard as the same would be known to artisans.

While the specification concludes with claims defining the features of the present disclosure that are regarded as novel, it is believed that the present disclosure's teachings will be better understood from a consideration of the following description in conjunction with the appendices, figures, in which like reference numerals are carried forward. All descriptions and callouts in the Figures are hereby incorporated by this reference as if fully set forth herein.

DETAILED DESCRIPTION

The present inventor has discovered that by adding a body with attachment to anything with certain types of straps is a fail-safe mechanism and a personalizing icon can be combined into a new apparatus.

This disclosure provides a device and system to allow the user to customize and provide for improved binding strap support and ready releasable fastening and detachment of the bindings as has not been heretofore provided. The present inventor has discovered that one can combine conventional binding systems with an enhancement to at least one male snowboard binding strap and provide a customization tool.

FIG. 1 shows a stud 88, which is customizable because it is capable of attaching to a variety of individualized screw tops 99. The screw top 99 is configurable in any number of personalized shapes, including characters, strings, logos, icons and anything that attaches thereto. The stud 88 is connected to the male strap 77, shown in cross-section. The attachment can be by any means known in the art, including by screws, magnets, adhesives, and the like.

The attachment 99 which is configurable in any number of personalized shapes, including characters, strings, logos, icons and anything that attaches to show your own snowboard.

Figure 2:
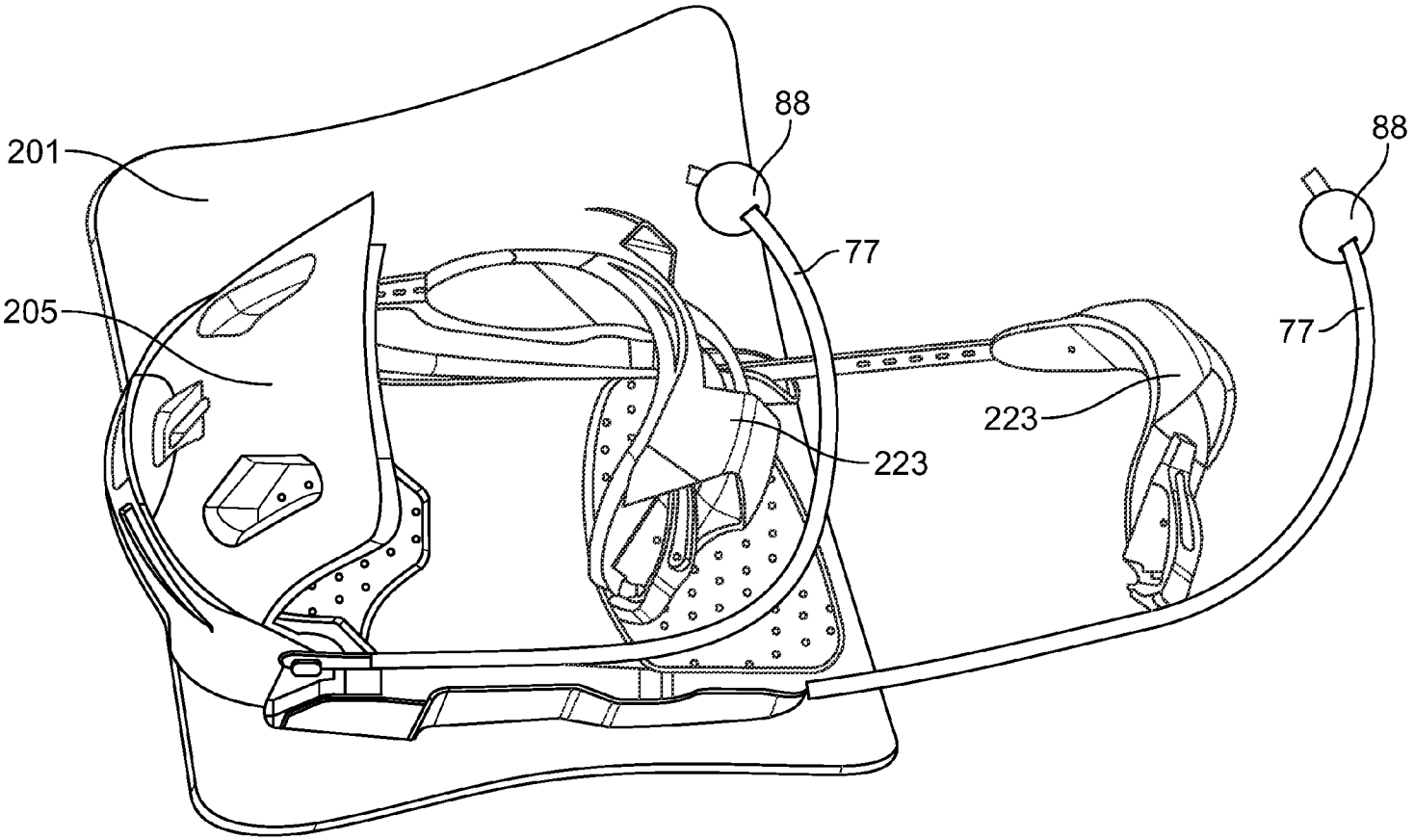
FIG. 2 schematically illustrates the sites for attachment of aspects of improvements, according to the present inventions, with a conventional binding showing one attachment site.

FIG. 2 shows a snowboard binding apparatus 205 attached to a snowboard 201. The binding apparatus 205 has two attachment mechanisms, one for the ankle and one for the toe. Each of the binding mechanisms comprises an elongated male strap 77, which can be fed through its corresponding female ratcheting mechanism 223. At the end of each strap 77 there is a stud 88, which is capable of preventing the strap from slipping back through and disconnecting from the female ratcheting mechanism, thereby preventing the male and female pieces from coming apart. For ease of viewing, the figure is depicted with the male straps 77 not engaged with the female ratcheting mechanisms 223. However, in practice the user would connect the studs 88 only after the male and female pieces are connected. The combination of the stud 88 with the amply elongated male strap 77 results in a binding connection that can be loosened to easily allow the boot in and out of the binding, but at the same time prevents the strap from coming all the way out. The conventional snowboard bindings of FIG. 2 are enhanced with strapping extensions 77 as known to those skilled in the art to have taken many forms. As is known to those skilled in the art, there are many types of straps that can be utilized with the disclosed invention. Ladder straps or other ratcheting connections are of particular use in snowboarding equipment.

Strapping extension are typically 7.5", but the present invention contemplatesa 16" ankle strap. This way, the binding straps never fully come apart. Instead, undoing the binding results in the strap loosening enough to allow the user's boot to go in an out, but keeps the connection in place so that the user can quickly and easily lean over and re-strap his foot.

Figure 3A:
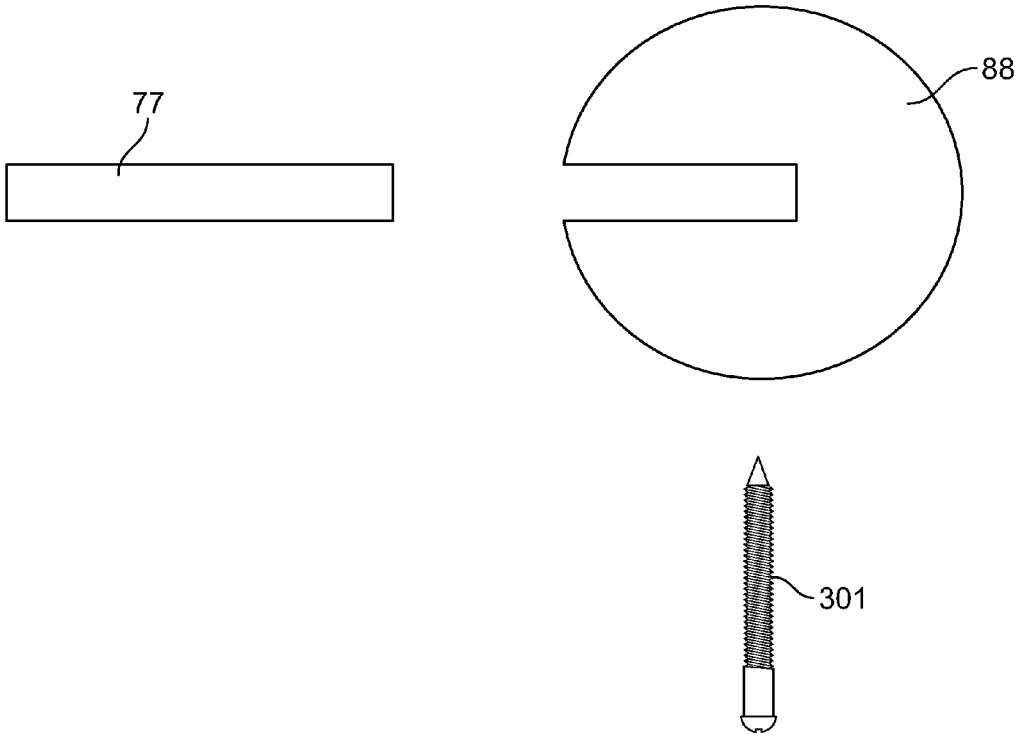
FIG. 3A schematically illustrates the components of one possible configuration for how the stud is held in place on the male strap.

FIG. 3A shows a schematic view of the components of the invention and how they could fit together. The male strap 77 is connectable to the stud 88 via an opening, mouth, indentation, orifice, aperture, or the like. The male strap 77 can comprise a strap, belt, band, rope, cord, cable or the like. The male strap 77 and the stud 88 can be attached by means of a screw 301 or a similar mechanism, including a clamp, a magnet, a bolt latch, a lock, or the like.

Figure 3B:
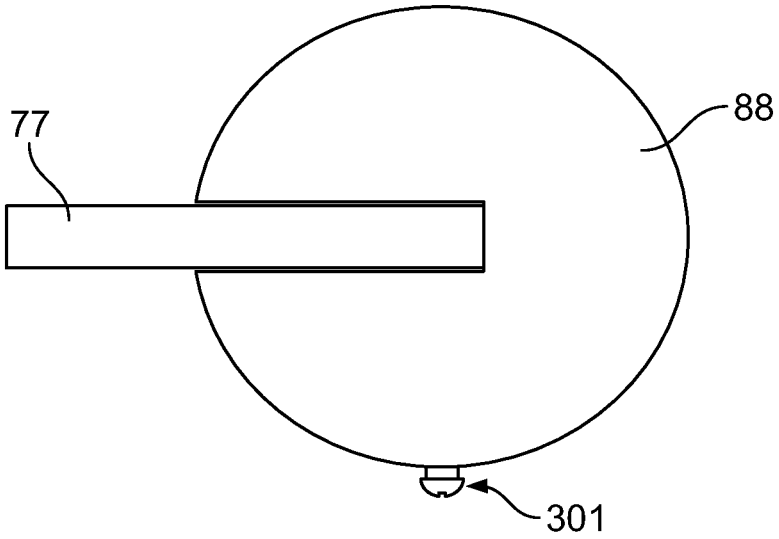
FIG. 3B shows the components as they fit together, according to embodiments.

FIG. 3B shows the components of FIG. 3A in their assembled configuration. The male strap 77 fits inside the stud 88. The screw 301 holds the pieces together.

Those skilled in the art understand how any strapped item functions with to instant invention, so further details are omitted.

While the method and apparatus have been described in terms of what are presently considered to be the most practical and preferred implementations, it is to be understood that the disclosure need not be limited to the disclosed implementations. It is intended to cover various modifications and similar arrangements included within the spirit and scope of the claims, the scope of which should be accorded the broadest interpretation so as to encompass all such modifications and similar structures. The present disclosure includes any and all implementations of the following claims.

It should also be understood that a variety of changes may be made without departing from the essence of the disclosure. Such changes are also implicitly included in the description. They still fall within the scope of this disclosure. It should be understood that this disclosure is intended to yield a patent covering numerous aspects of the disclosure both independently and as an overall system and in both method and apparatus modes.

Further, each of the various elements of the disclosure and claims may also be achieved in a variety of manners. This disclosure should be understood to encompass each such variation, be it a variation of an implementation of any apparatus implementation, a method or process implementation, or even merely a variation of any element of these.

Particularly, it should be understood that as the disclosure relates to elements of the disclosure, the words for each element may be expressed by equivalent apparatus terms or method terms—even if only the function or result is the same.

Such equivalent, broader, or even more generic terms should be considered to be encompassed in the description of each element or action. Such terms can be substituted where desired to make explicit the implicitly broad coverage to which this disclosure is entitled.

It should be understood that all actions may be expressed as a means for taking that action or as an element which causes that action.

Similarly, each physical element disclosed should be understood to encompass a disclosure of the action which that physical element facilitates.

Any patents, publications, or other references mentioned in this application for patent are hereby incorporated by reference. In addition, as to each term used it should be understood that unless its utilization in this application is inconsistent with such interpretation, common dictionary definitions should be understood as incorporated for each term and all definitions, alternative terms, and synonyms such as contained in at least one of a standard technical dictionary recognized by artisans and the Random House Webster's Unabridged Dictionary, latest edition are hereby incorporated by reference.

Finally, all referenced listed in the Information Disclosure Statement or other information statement filed with the application are hereby appended and hereby incorporated by reference; however, as to each of the above, to the extent that such information or statements incorporated by reference might be considered inconsistent with the patenting of this/these disclosure(s), such statements are expressly not to be considered as made by the applicant(s).

In this regard it should be understood that for practical reasons and so as to avoid adding potentially hundreds of claims, the applicant has presented claims with initial dependencies only.

Support should be understood to exist to the degree required under new matter laws—including but not limited to United States Patent Law 35 USC 132 or other such laws—to permit the addition of any of the various dependencies or other elements presented under one independent claim or concept as dependencies or elements under any other independent claim or concept.

To the extent that insubstantial substitutes are made, to the extent that the applicant did not in fact draft any claim so as to literally encompass any particular implementation, and to the extent otherwise applicable, the applicant should not be understood to have in any way intended to or actually relinquished such coverage as the applicant simply may not have been able to anticipate all eventualities; one skilled in the art, should not be reasonably expected to have drafted a claim that would have literally encompassed such alternative implementations.

Further, the use of the transitional phrase "comprising" is used to maintain the "open-end" claims herein, according to traditional claim interpretation. Thus, unless the context requires otherwise, it should be understood that the term "compromise" or variations such as "comprises" or "comprising", are intended to imply the inclusion of a stated element or step or group of elements or steps but not the exclusion of any other element or step or group of elements or steps.

Such terms should be interpreted in their most expansive forms so as to afford the applicant the broadest coverage legally permissible.

What is claimed is:

1. A device for preventing a strap from becoming detached from a receptor piece, the device comprising:

a stud configured to securely attach to a distal end of a male strap, the male strap having been fed through a female receptor piece; and a screw connecting the stud to the male strap;

wherein the male strap and female receptor piece are part of a piece of sports and leisure equipment selected from the group of snowboard bindings, wake board bindings, backpacks, fanny packs, luggage, climbing gear, and sweatshirts having strings.

2. A device for preventing a strap from becoming detached from a receptor piece, the device comprising:

a stud configured to securely attach to a distal end of a male strap, the male strap having been fed through a female receptor piece;

a screw connecting the stud to the male strap; and a customizable piece attached to the stud, wherein the customizable piece is readily exchangeable by detachably screwing in and out replacement pieces.

3. The device of claim 2, wherein the customizable piece comprises one selected from a list including: a personalized shape; an icon; a character; an emblem; and a figurine.

4. A snowboard binding device comprising:

an elongated male strap;

a female receptor piece, configured to receive the male strap;

a stud configured to be attached to a distal end of the male strap, the stud being of a size and shape that mechanically prevents the male strap from coming out of the female receptor when the stud is attached; and a customizable piece attached to the stud, wherein the customizable piece is interchangeable with other matchable pieces.

5. The device of claim 4, wherein the customizable piece comprises one selected from a list including: a personalized shape; an icon; a character; an emblem; and a figurine.

6. A device for riding on a snow surface, the device comprising:

an elongated board;

two binding apparatuses attached to the board, each binding apparatus comprising:

a female connection piece;

a male strap positioned through the female connection piece; and a stud affixed to a distal portion of the male strap, the stud configured to prevent the male strap from decoupling from the female connection piece.

7. The device of claim 6, wherein the strap is a ladder strap.

8. The device of claim 6, wherein the male strap and female receptor piece are part of a snowboard binding.

9. The device of claim 6, further comprising a customizable piece attached to the stud, wherein the customizable piece.

10. The device of claim 9, wherein the customizable piece comprises one selected from a list including: a personalized shape; an icon; a character; an emblem; and a figurine.

11. A stylized apparatus for bindingly accepting a strap, belt, or cord, the apparatus comprising:

a body; and a securement manner for securing the body to the strap, belt, or cord;

wherein the body and the securement manner are part of a backpack, hooded sweatshirt having strings, or other sports and leisure articles.

12. A stylized apparatus for bindingly accepting a strap, belt, or cord, the apparatus comprising:

a body;

a securement manner for securing the body to the strap, belt, or cord; and a customizable piece attached to the body, wherein the customizable piece may be part of a matched-set of pieces for other personal leisure goods selected from the group of backpacks, ski-boots, wake board bindings, fanny-packs, travel gear, outdoor gear, climbing gear and boot straps.

13. The device of claim 12, wherein the customizable piece comprises one selected from a list including: a personalized shape; an icon; a character; an emblem; and a figurine.

* * * * *